United States Patent [19]

Trossman

[11] Patent Number: 4,689,032

[45] Date of Patent: Aug. 25, 1987

[54] WATER TOY

[75] Inventor: Martin M. Trossman, Westwood, N.J.

[73] Assignee: Hasbro, Inc., Pawtucket, R.I.

[21] Appl. No.: 802,925

[22] Filed: Nov. 29, 1985

[51] Int. Cl.[4] ..... A63H 23/02; B63B 21/27; B63B 21/00

[52] U.S. Cl. ..... 446/160; 446/153; 446/177; 446/183; 114/230; 114/296

[58] Field of Search ..... D21/130, 149; 446/177, 446/153–155, 160, 180, 183; 114/296, 230, 263; 273/1 L, DIG. 25, 350

[56] References Cited

U.S. PATENT DOCUMENTS

| | | | |
|---|---|---|---|
| D. 168,130 | 11/1952 | Stirratt | D21/130 X |
| D. 230,366 | 2/1974 | Schmidt et al. | D21/130 |
| D. 247,384 | 2/1978 | Nakao | D21/130 |
| D. 250,788 | 1/1979 | Nakao et al. | D21/149 |
| D. 258,071 | 1/1981 | Walker | D21/130 |
| D. 262,948 | 2/1982 | Mayenschein et al. | D21/130 X |
| D. 275,974 | 10/1984 | Rivollet | D6/369 |
| 798,750 | 9/1905 | Sinclair | 446/153 |
| 1,386,425 | 8/1921 | Rendtorff | 446/159 |
| 2,900,758 | 8/1959 | Glass | 446/158 |
| 3,095,197 | 6/1963 | Weitzman | 273/1 L X |
| 3,577,675 | 5/1971 | Kohner et al. | 446/177 X |
| 4,034,851 | 7/1977 | Barksdale | 446/153 X |
| 4,223,894 | 9/1980 | Fabricant | 446/160 X |
| 4,292,758 | 10/1981 | Kuna et al. | 446/7 |
| 4,519,783 | 5/1985 | Burke | 114/296 X |
| 4,532,879 | 8/1985 | Ortloff | 114/230 |
| 4,588,618 | 5/1986 | Wolfe | 446/153 X |

FOREIGN PATENT DOCUMENTS

| | | | |
|---|---|---|---|
| 48794 | 7/1911 | Austria | 446/153 |
| 758109 | 9/1956 | United Kingdom | 446/177 |
| 1080189 | 8/1966 | United Kingdom | 114/296 |

*Primary Examiner*—Robert A. Hafer
*Assistant Examiner*—Terrence L. B. Brown
*Attorney, Agent, or Firm*—Salter & Michaelson

[57] ABSTRACT

A water toy for infants comprises a floatable portion and a restraining portion for loosely restraining the floatable portion so that the floatable portion when floated in water in a pool or tub in which an infant is playing or being bathed is enabled to bob up and down, pitch and roll, spin through an angle of 360° about a vertical axis, and move over a limited portion of the surface of the water but prevented from moving and remaining beyond the reach of the infant. Various ancillary toys are included.

16 Claims, 6 Drawing Figures

WATER TOY

BACKGROUND OF THE INVENTION

1. Field of the Invention

This invention relates to toys and, more particularly, to a novel and highly-effective water toy for infants.

2. Description of the Prior Art

Child psychologists agree that toys are vitally important to infants and young children. They stimulate curiosity, promote mental and physical development, and provide entertainment. Water toys are particularly valuable for these purposes.

A problem of conventional water toys is that an infant playing with such a toy almost immediately loses it in the water. Water toys typically float, so that they drift away when the infant "bats" them. This can become very trying to the infant's supervisor, who must continually retrieve the toy in order for play to continue.

Representative conventional water toys are disclosed in U.S. Pat. Nos. 1,386,425; 2,900,758; 4,223,894 and 4,292,758 and design patents Nos. 247,384 250,788; 258,071 and 275,974. These patents fail to disclose a solution to the problem noted above.

OBJECTS AND SUMMARY OF THE INVENTION

An object of the invention is to remedy the problem noted above and, in particular, to provide a water to for infants that floats and moves about on the water when batted but stays within reach of an infant playing with it.

The foregoing and other objects are attained, in accordance with one aspect of the invention, by a water toy for infants comprising: a floatable portion; and a restraining portion for loosely restraining the floatable portion so that the floatable portion when floated in water in a pool or tub in which an infant is playing or being bathed is enabled to bob up and down, pitch and roll, spin through an angle of 360° about a vertical axis, and move over a limited portion of the surface of the water but prevented from moving and remaining beyond the reach of the infant.

BRIEF DESCRIPTION OF THE DRAWINGS

A better understanding of the objects, features and advantages of the invention can be gained from the following detailed description of the preferred embodiment thereof, in conjunction with the appended drawings, wherein.

DESCRIPTION OF THE PREFERRED EMBODIMENT

Figure 1:
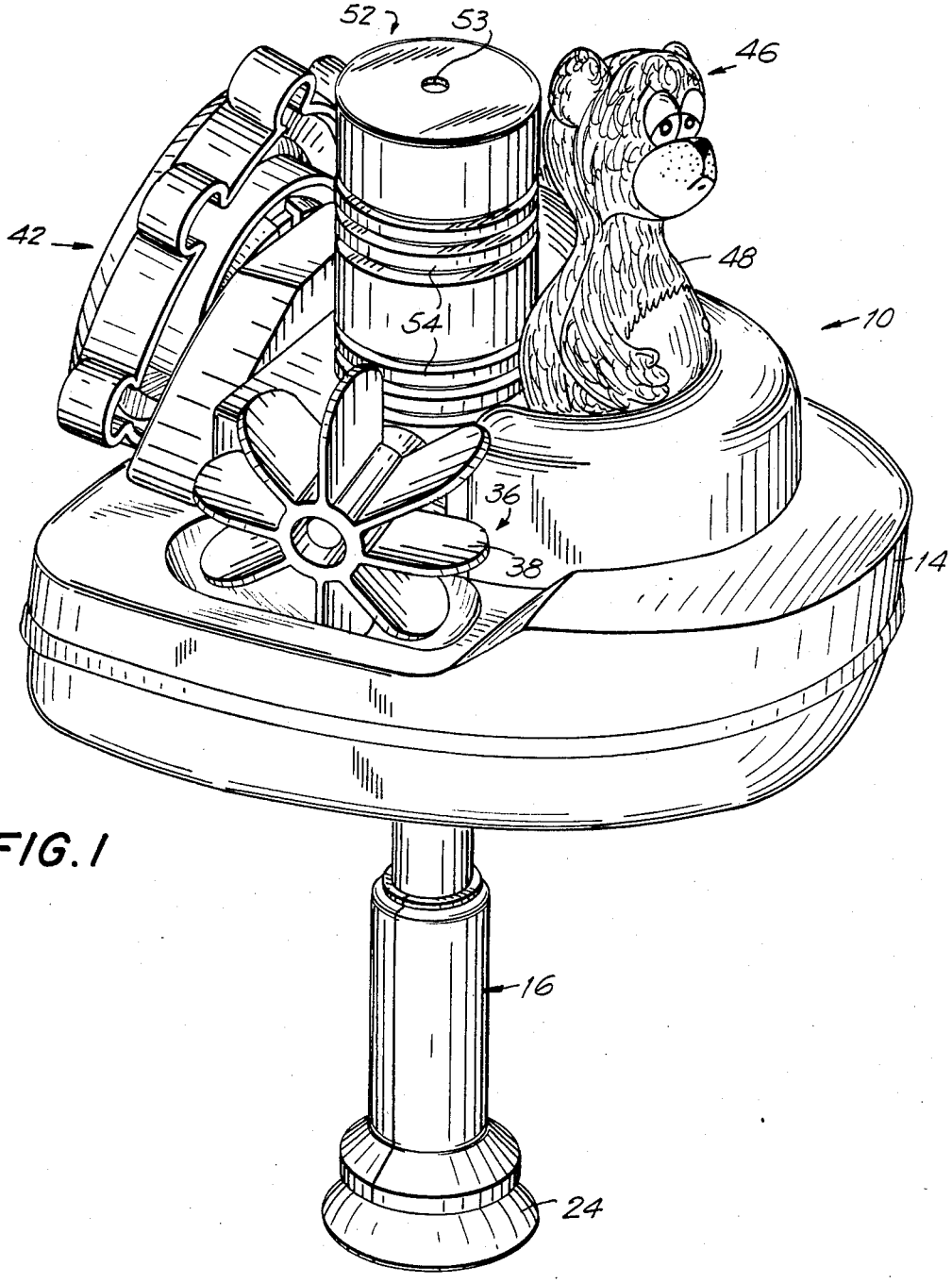
FIG. 1 is a perspective view of a preferred embodiment of a water toy in accordance with the invention.
Figure 2:
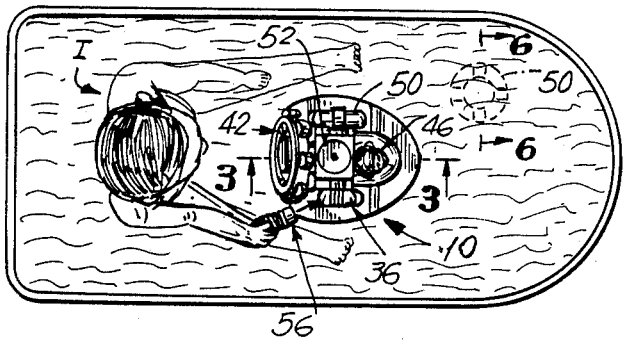
FIG. 2 is a diagrammatic top plan view on a smaller scale than FIG. 1 of an infant playing with the water toy of FIG. 1.
Figure 3:
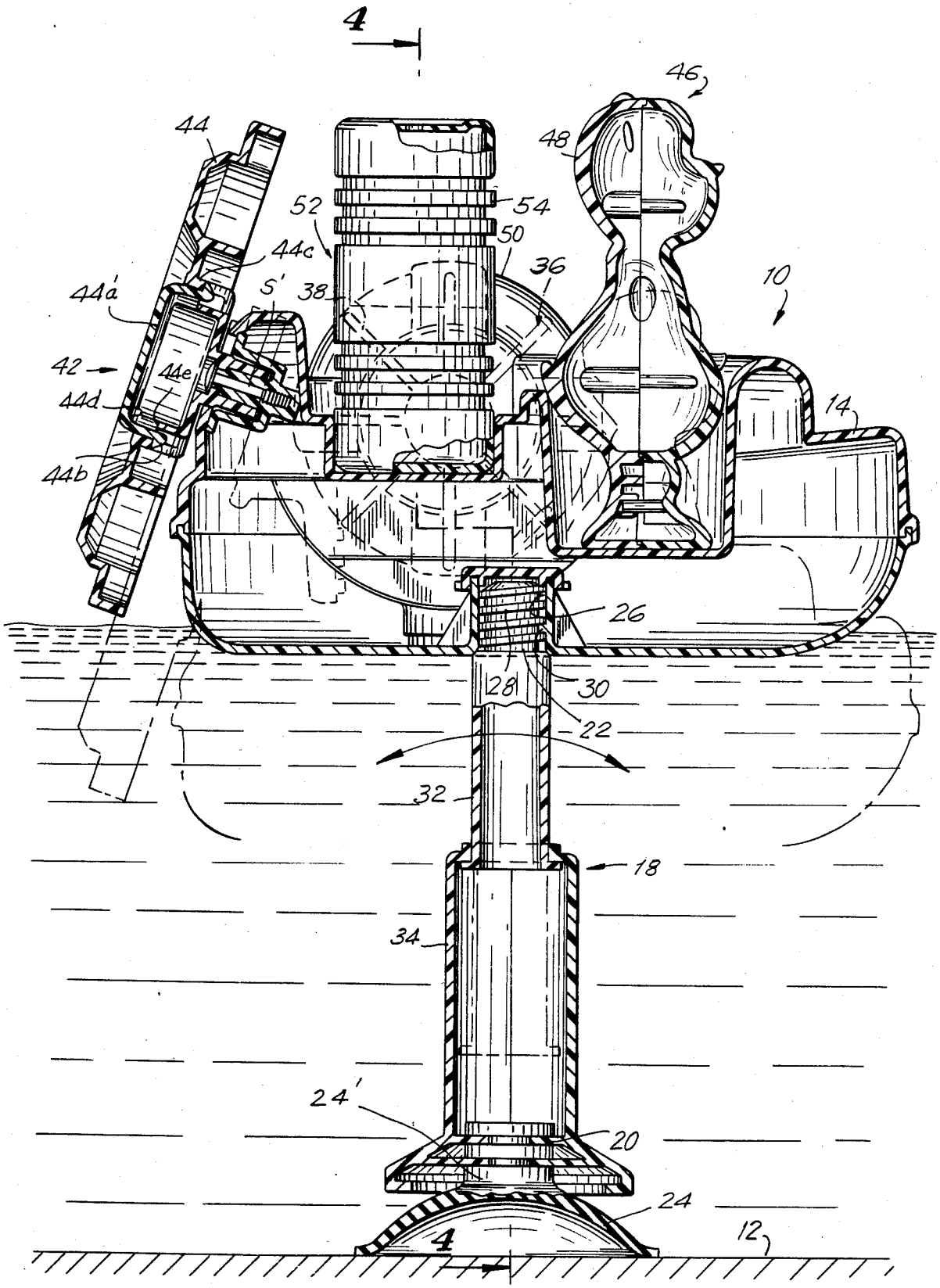
FIG. 3 is a view on a larger scale than FIG. 2 taken substantially along the line 3—3 of FIG. 2 and looking in the direction of the arrows.
Figure 4:
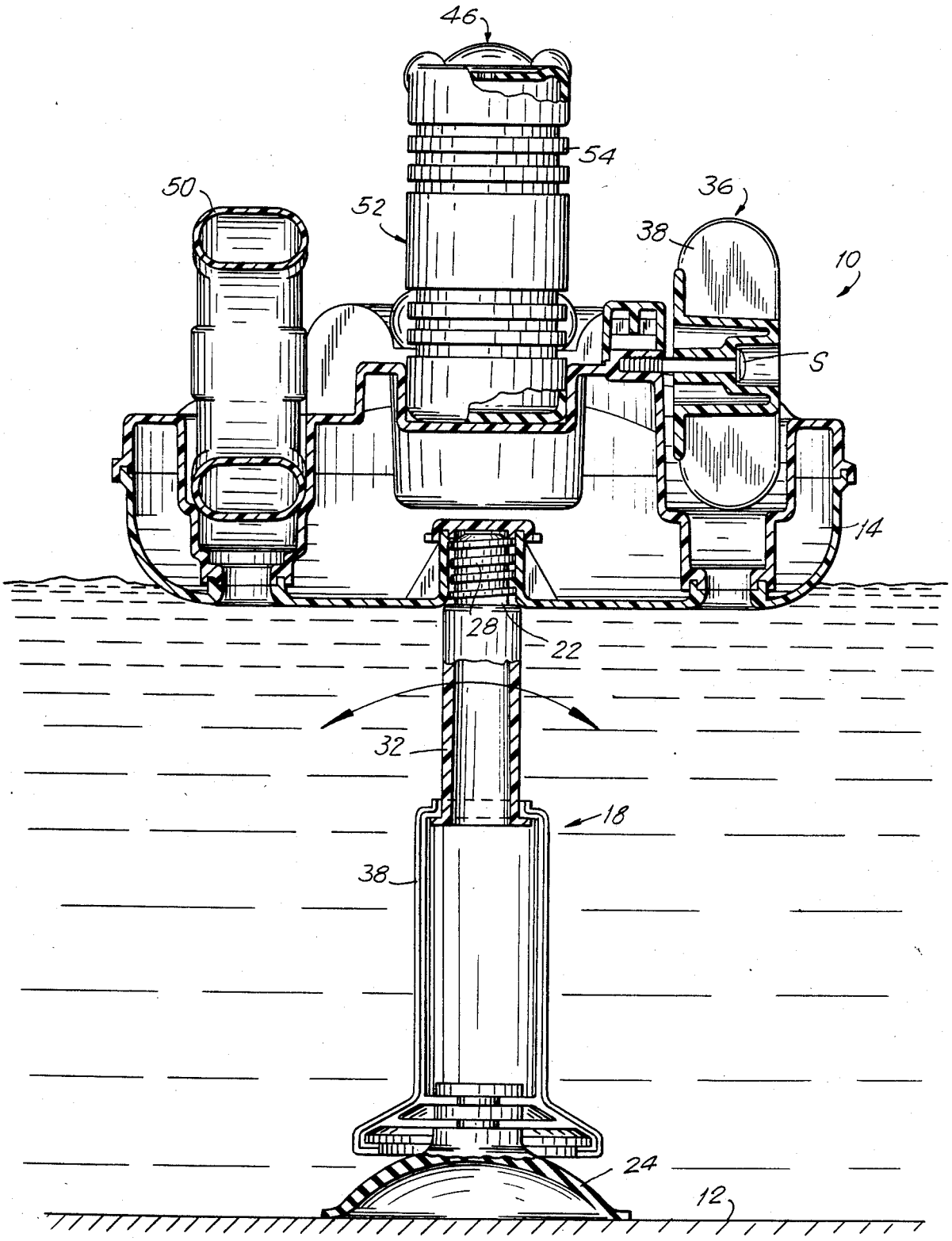
FIG. 4 is a view taken substantially along the discontinuous line 4—4 of FIG. 3 and looking in the direction of the arrows.
Figure 5:
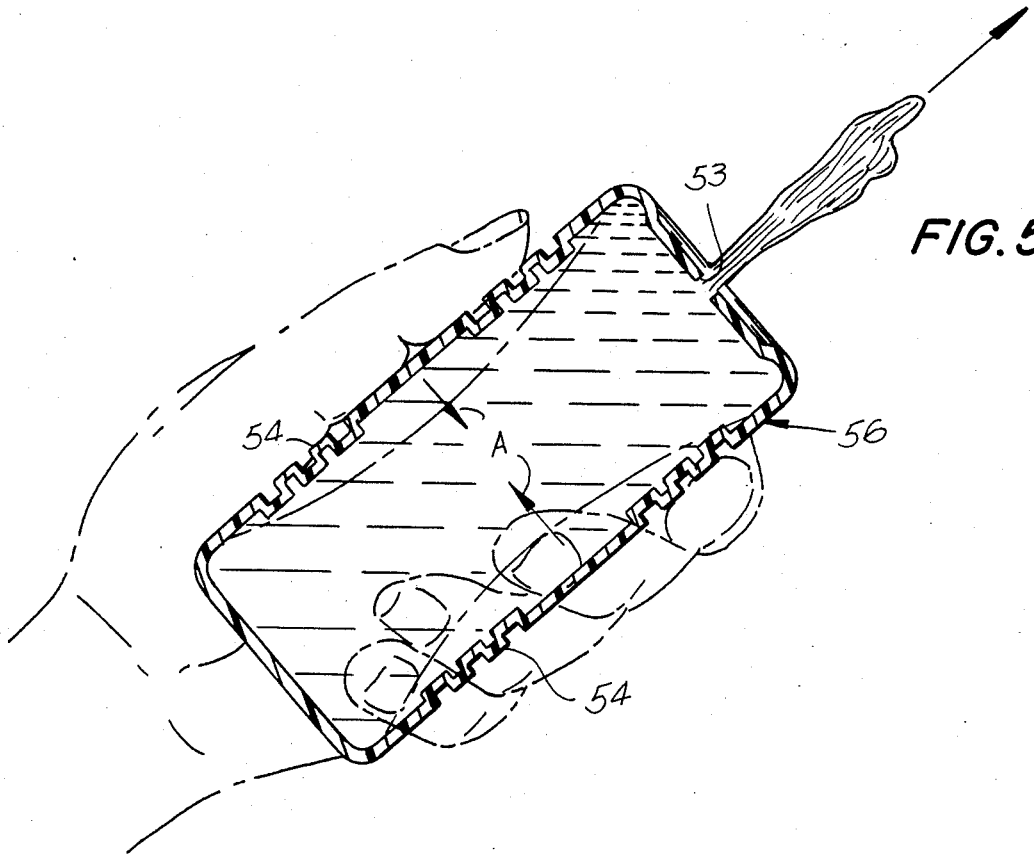
FIG. 5 is a longitudinal sectional view of a detachable portion of the water toy of FIG. 1 illustrating a mode of operation of which such detachable portion is capable.
Figure 6:
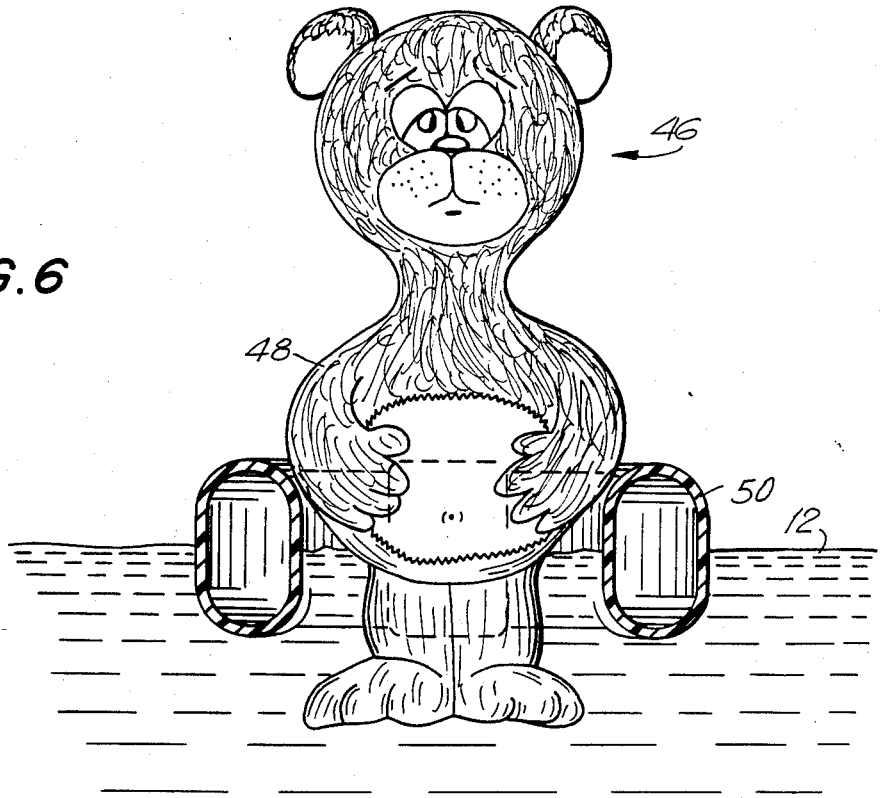
FIG. 6 is a sectional view of a second detachable portion of the water toy of FIG. 1, on a larger scale than FIG. 2, taken substantially along the line 6—6 of FIG. 2 and looking in the direction of the arrows, and a front elevational view of a third detachable portion of the water toy of FIG. 1 accommodated within the second detachable portion.

FIGS. 1–4 show a water toy 10 in accordance with the invention, and FIGS. 5 and 6 show three detachable portions thereof. The water toy 10 is especially adapted for use by an infant I (FIG. 2) playing or being bathed in a pool or tub 12. Depending on the age and development of motor coordination and balance of the infant and on the depth of water in the pool or tub 12, the infant may be in a sitting position as shown in FIG. 2 or may be in a recumbent or other position enabling play with the toy 10.

The toy 10 comprises a floatable portion 14 resembling a boat and a restraining portion 16 for loosely restraining the floatable portion 14 so that the floatable portion 14 when floated in water in the pool or tub 12 in which the infant is playing or being bathed is enabled to bob up and down, pitch through a limited angle about a transverse axis, roll through a limited angle about a longitudinal axis, spin through an angle of 360° about a vertical axis, and move (translate) over a limited portion of the surface of the water but prevented from moving and remaining beyond the reach of the infant. Thus an infant too young to pursue a toy that can float away can be entertained indefinitely by a water toy according to the invention, even without the active participation of an adult or other supervisor.

The restraining portion 16 preferably comprises a part 18 (FIG. 3) engageable securely at one end 20 with the pool or tub 12 and at the other end 22 with the floatable portion 14. The restraining portion 16 preferably further comprises suction cup means 24 connected to the part 18 at the end 20 for forming a suction attachment to the pool or tub 12. The suction cup 24 is elastomeric and has a flexible neck 24' enabling the part 18 to bend in any direction away from the vertical. As an alternative to a suction cup, a magnet (not shown) can be used for forming an attachment to the tub, etc., if the latter is made of a magnetizable material. The floatable portion 14 is formed with a recess 26 therein, and the post 18 is insertable within the recess 26, the post 18 and recess 26 being complementally configured so that the post 18 can be securely retained within the recess 26. For example, the post 18 may be formed with a thread 28 engageable with a complemental thread (not shown) or with a flange 30 extending radially inwardly.

The post 18 forming a part of the restraining portion 16 has an upper section 32 engageable with the floatable portion 14 and a lower section 34 engageable with the pool or tub 12. The upper and lower sections 32 and 34 are connected to each other in telescoping relation, thereby facilitating use of the toy in different water depths, a bobbing motion of the floatable portion 14, and a yawing or spinning of the floatable portion 14 through an angle of 360° about a vertical axis. The elastomeric suction cup 24 with its flexible neck 24' facilitates pitching of the floatable portion 14 about a transverse axis and rolling thereof about a longitudinal axis, as well as an accompanying movement (translation) over a limited area of the surface of the water.

A simulated means of propulsion 36 is connected to the floatable portion 14. The simulated means of propulsion 36 preferably comprises a simulated paddle wheel 38. The paddle wheel 38 may be secured by an axially extending screw S (FIG. 4) either rigidly or in such a manner that it can be rotated but not removed by the infant.

A simulated means of steering 42 is also connected to the floatable portion 14. The simulated means of steering preferably comprises a simulated steering wheel 44. The steering wheel 44 may be secured by an axially extending screw S' (FIG. 3) either rigidly or in such a manner that the wheel 44 can be rotated but not removed by the infant. A noisemaker comprising a horn button 44*a* is secured to the steering wheel 44 in such a manner as to be movable axially (to the right in FIG. 3) with respect to the wheel 44 for the purpose of emitting a horn-like sound. The horn button 44*a* is retained within the steering wheel 44 by an outwardly turned flange 44*b* that engages a flange 44*c* integral with the steering wheel 44. The downward stroke of the horn button 44*a* (to the right in FIG. 3) is limited by engagement of the rear face 44*d* of the horn button 44 with an annular flange 44*e* which is immovable with respect to the wheel 44 in the axial direction of the wheel.

At least one ancillary toy is preferably removably supported by the floatable portion 14. The ancillary toy may comprise a simulated captain 46. The simulated captain 46 is preferably an anthropomorphic animal FIG. 48.

The ancillary toy may comprise also a simulated life preserver 50 (FIGS. 2, 3, 4 and 6) for the simulated captain 46. The life preserver 50 is removably housed in a well 50*a* and when so housed is positioned symmetrically with respect to the paddle wheel 38 on the opposite side of the median vertical fore-and-aft plane of the floatable portion 14. The simulated captain 46 may be denser than water so that the simulated life preserver 50 is necessary to "preserve the life" of the simulated captain in case he "abandons ship" (FIG. 6).

The ancillary toy preferably further comprises a simulated stack 52. The simulated stack 52 is hollow and formed with an aperture 53 therein and made of a flexible material having corrugated portions 54 so that it is expandable to ingest water and compressible as indicated by arrows A (FIG. 5) to function as a water squirter 56.

The toy 10 and all of the detachable portions 48, 50, 52 thereof are large enough that they cannot be swallowed or inhaled by the infant. They are moreover constructed without sharp or otherwise dangerous edges or points. They can be made of a rugged, inexpensive plastic which is not damaged by prolonged contact with water.

While the ancillary detachable toys 46, 48, 50 may drift or be batted beyond the reach of the infant, the floatable portion 14 with its restraining portion 16 will remain within the reach of the infant, so that the infant's supervisor need not provide a continuous retrieval service in order for play to continue. This is clearly an advantage for both the infant and the supervisor.

Moreover, although the floatable portion 14 is restrained as described above, the restraint is loose, so that the floatable portion 14 executes, within a confined area, all of the types of movements of which a totally unrestrained floatable portion is capable (bobbing, translation over the surface, pitching, rolling and yawing or spinning). The toy thus is adapted to provide entertainment for the infant over an extended period of time.

Thus there is provided in accordance with the invention a novel and highly-effective water toy for infants. The invention remedies a major problem of conventional water toys in that, in accordance with the invention, there is provided a water toy for infants that floats and moves about on the water when batted but stays within reach of an infant playing with it. The water toy of the invention moreover includes a plurality of ancillary toys that maintain the interest of an infant for an extended period of play.

Many modifications of the preferred embodiment of the invention disclosed herein will readily occur to those skilled in the art upon consideration of this disclosure. In particular, the design of the floatable portion 14 and of the restraining portion 16 can be varied within wide limits provided only that the restraining portion loosely restrain the floatable portion so that the floatable portion when floated in water in a pool or tub in which an infant is playing or being bathed is enabled to bob up and down, and move over a limited portion of the surface of the water, and execute pitching, rolling and yawing or spinning movements as described above but prevented from moving and remaining beyond the reach of the infant. Moreover, the number and nature of the ancillary toys can be varied, as those skilled in the art will readily appreciate. Accordingly, the invention is not limited except by the appended claims.

I claim:

1. A water toy for infants comprising:

a floatable portion; and a restraining portion for loosely restraining said floatable portion so that said floatable portion when floated in water in a pool or tub in which an infant is playing or being bathed is enabled to bob up and down, pitch and roll, spin through an angle of 360° about a vertical axis, and move over a limited portion of the surface of the water but prevented from moving and remaining beyond the reach of the infant, said restraining portion comprising a post having an upper section engageable with said floatable portion and a lower section engageable with said pool or tub, said upper and lower sections being connected to each other in telescoping relation, thereby facilitating a bobbing motion of said floatable portion and use of said toy in different water depths.

2. A water toy according to claim 1; wherein said restraining portion comprises a post engageable at one end with said pool or tub and at the other end with said floatable portion.

3. A water toy according to claim 2; wherein said restraining portion further comprises suction cup means connected to said post at said one end for forming a suction attachment to said pool or tub.

4. A water toy according to claim 2; wherein said floatable portion is formed with a recess therein and said post is insertable within said recess, said post and recess being complementally configured so that said post can be securely retained within said recess.

5. A water toy according to claim 1; wherein said restraining portion comprises a post and suction cup means connected to said post at one end for forming a suction attachment to the bottom of said pool or tub and holding said post in a generally vertical position; and wherein said floatable portion is formed with a recess in the bottom thereof and the upper end of said post is insertable within said recess, said post and recess being complementally configured so that said post can be retained within said recess. depths.

6. A water toy according to claim 1; further comprising a simulated means of propulsion connected to said floatable portion.

7. A water toy according to claim 6; wherein said simulated means of propulsion comprises a simulated paddle wheel.

8. A water toy according to claim 1; further comprising a simulated means of steering connected to said floatable portion.

9. A water toy according to claim 8; wherein said simulated means of steering comprises simulated steering wheel.

10. A water toy according to claim 9; further comprising a noisemaker connected to said simulated means of steering.

11. A water toy according to claim 1; further comprising at least one ancillary toy removably supported by said floatable portion.

12. A water toy according to claim 11; wherein said ancillary toy comprises a simulated captain.

13. A water toy according to claim 12; wherein said simulated captain is an anthropomorphic animal figure.

14. A water toy according to claim 12; wherein said ancillary toy comprises a simulated life preserver for said simulated captain.

15. A water toy according to claim 11; wherein said ancillary toy comprises a simulated stack.

16. A water toy according to claim 15; wherein said simulated stack is hollow and formed with an aperture therein and made of a flexible material so that it is expandable to ingest water and compressible to function as a water squirter.

* * * * *